United States Patent [19]

Yoshida et al.

[11] Patent Number: 4,504,577

[45] Date of Patent: Mar. 12, 1985

[54] SILVER HALIDE PHOTOGRAPHIC MATERIALS

[75] Inventors: Yoshinobu Yoshida; Nobuo Sakai; Takatoshi Ishikawa, all of Kanagawa, Japan

[73] Assignee: Fuji Photo Film Co., Ltd., Kanagawa, Japan

[21] Appl. No.: 583,929

[22] Filed: Feb. 27, 1984

[30] Foreign Application Priority Data

Feb. 25, 1983 [JP] Japan ..... 58-31612

[51] Int. Cl.[3] ..... G03C 1/33; G03C 1/02

[52] U.S. Cl. ..... 430/564; 430/607; 430/613; 430/614; 430/634

[58] Field of Search ..... 430/634, 564, 543, 600, 430/607, 613, 614

[56] References Cited

U.S. PATENT DOCUMENTS 3,312,552 4/1967 Müller-Bardorff ..... 430/634

*Primary Examiner*—Mary F. Downey

*Attorney, Agent, or Firm*—Sughrue, Mion, Zinn, Macpeak & Seas

[57] ABSTRACT

A silver halide photographic material is disclosed which is comprised of a support having formed thereon a light-sensitive silver halide layer and a particular compound represented by the general formulae (I), (II) and (III). The compound is utilized in the photographic material in order to prevent the occurrence of contaminations which are caused by metals intermixed in the silver halide photographic materials during production, packaging, preservation and/or processing. The presence of such compounds also prevents the deterioration of photographic materials caused by metal ions existing in processing solutions and aids in preventing the reduction in the uniformity of processing.

11 Claims, No Drawings

SILVER HALIDE PHOTOGRAPHIC MATERIALS

FIELD OF THE INVENTION

This invention relates to a light-sensitive photographic material having at least one silver halide emulsion layer on a support, and more particularly to a silver halide photographic material containing a novel compound for preventing the occurrence of contamination by metals intermixed during the production, packaging, preservation, processing, etc., of the silver halide photographic material.

BACKGROUND OF THE INVENTION

Considerable efforts have been made for preventing the occurrence of contamination in silver halide photographic materials by intermixture of metals or metal compounds which have undesirable influences on the photographic materials during the production, packaging, preservation, processing, etc., of the photographic materials. However, in spite of such efforts, these metals or metal compounds are brought into contact with silver halide photographic materials as fine particles of them in the air, or in suspensions of solutions which results in giving stains, spots, color stains, changes of tone, etc., undesirable to the photographic materials after processing.

The metals or metal compounds having undesirable influences on silver halide photographic materials are, in particular, iron, aluminum, chromium, nickel, copper, etc., and the compounds of these metals. However, they are not limited to these mateials and include alkaline earth metals such as magnesium, calcium, strontium, etc., and the compounds of them.

The metal such as, for example, iron in the form of very fine particles is easily oxidized into Fe (II) or Fe (III) to desensitize the silver halide of a silver halide photographic material by contact with the oxidized products or Fe and Fe (II) are respectively oxidized into Fe (II) and Fe (III) with the release of electrons to sensitize the silver halide of a silver halide photographic material by contact with the electrons, whereby contaminations are formed on the silver images after processing. Also, in a color photographic material the foregoing contaminations of the silver image are converted into contaminations of color image.

Furthermore, these metals or metal compounds not only have undesirable influences on silver halide emulsions but also sometimes react with photographically useful additives (e.g., color image providing compounds such as couplers, diffusion transfer dyes, etc., sensitizing dyes, antifoggants, fading preventing agents, hardening agents, binders, etc.) to give undesirable influences, such as the occurrence of stains, spots, color stains, tone changes, etc. (hereinafter, they are generally referred to as "image contamination") to images.

Furthermore, for the preparation of processing solutions used for processing silver halide photographic materials, natural water such as well water, city water, etc., is usually used and it is known that such water contains alkaline earth metals such as calcium, magnesium, etc., and other materials dissolved therein and the kind and the contents of these materials greatly differ according to the nature of the soil with which the water was brought into contact (Chishitsu Chohsa-jo Kagakubunseki Seika-hyoh published by Tsusan-shoh Chishitsu Chohsa-jo; and Suishitsu Chohsahoh published by Maruzen Co., Ltd.).

Accordingly, it sometimes happens that a part of these metal ions dissolved in the processing solutions have undesirable influences during the processing of silver halide photographic materials, which results in undesirable effects on photographic properties, such as the reduction in image density, change of tone, occurrence of color turbidness, etc.

Phosphoric acid type chelating compound such as an alkali metal metaphosphate are conventionally used for preventing the occurrence of the foregoing image contaminations in silver halide photographic materials. However, such a chelating agent causes side effects as described in, for example, U.S. Pat. Nos. 3,443,951, 3,312,552 and 3,382,071. Furthermore, the foregoing U.S. Pat. No. 3,382,071 indicates that a hydroxylated polyamino-polycarboxylic acid such as an ethylenediaminetriacetic acid derivative is used as such as chelating agent but is insufficient. Moreover, Japanese Patent Application (OPI) No. 173829/82 (corresponding to U.S. Pat. No. 4,340,665) (the term "OPI" as used herein refers to a "published unexamined Japanese patent application") discloses a combination of a phosphate and trisodium hydroxyethylenediaminetriacaetate and further U.S. Pat. No. 3,488,707, British Pat. Nos. 952,162 and 1,221,138, Japanese Patent Application (OPI) No. 120628/74, U.S. Pat. No. 3,778,268, etc. disclose chelating agents such as phosphonic acid derivatives and polyaminopolycarboxylic acid derivatives, but they show low image contamination preventing faculty or cause many side effects.

On the other hand, U.S. Pat. No. 3,312,552 discloses that an ortho-hydroxybenzylamine derivative having an amino group substituted by a 2-alkyl radical including a carboxy group is incorporated in a silver halide photographic material. However, the compound disclosed in the foregoing U.S. Patent shows a lower image contamination preventing faculty than those of the compounds used in this invention as will be described hereinafter.

SUMMARY OF THE INVENTION

An object of this invention is, therefore, to prevent the occurrence of contaminations by metals intermixed in silver halide photographic materials during the steps of producing, packaging, preserving, and processing the photographic materials.

Another object of this invention is to prevent the deterioration of photographic properties caused by metal ions existing in processing solutions.

Still another object of this invention is to prevent the reduction in the uniformity of processing by the change of the nature of water used for the processing solution.

Those and other objects of this invention will become apparent by the following descriptions.

As the results of various investigations, the inventors have discovered that by incorporating at least one compound represented by following general formula (I), (II) or (III) in a silver halide photographic material, the occurrence of the foregoing image contamination, the deterioration of photographic properties and the reduction in the uniformity of processing can be remarkably prevented;

General formula (I):

-continued

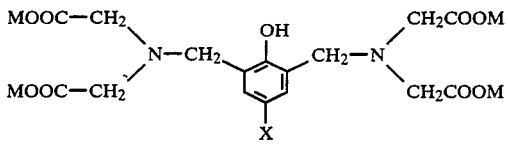

General formula (II):

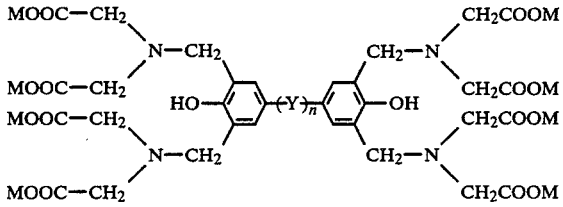

General formula (III):

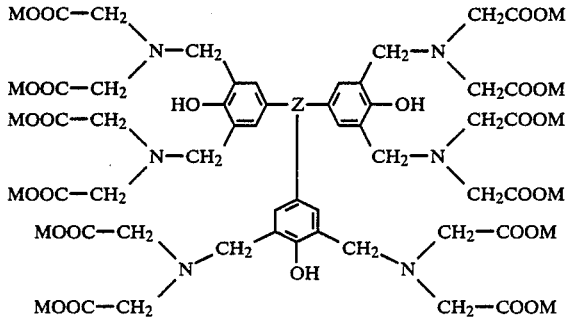

wherein X represents an alkyl group having 6 or more carbon atoms, an aryl group having 6 or more carbon atoms, an acylamino group having 7 or more carbon atoms, a heterocyclic amino group the heterocyclic moiety of which is 5- or 6-membered, a sulfonamido group having 6 or more carbon atoms, an alkoxycarbonyl group having 6 or more carbon atoms, a carbamoyl group having 6 or more carbon atoms, a sulfamoyl group having 6 or more carbon atoms, a sulfonyl group having 6 or more carbon atoms, or a 5- or 6-membered heterocyclic group; Y represents an alkylene group having 1 or more carbon atom, $—SO_2—$, or —CONH-RoNHCO— (wherein Ro represents an alkylene group having 1 or more carbon atom); Z represents

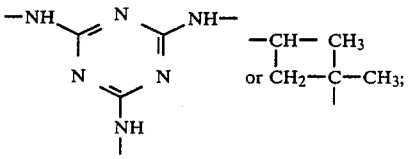

M represents a hydrogen atom, a sodium atom, or a potassium atom; and n represents 0 or 1.

DESCRIPTION OF THE PREFERRED EMBODIMENT

Compounds represented by the foregoing general formula (I), (II) or (III) are explained below in detail.

The alkyl group shown by X of general formula (I) preferably includes 6 to 16 carbon atoms and may be a straight or branched chain alkyl group. Preferred examples include a hexyl group, a heptyl group, an octyl group, a nonyl group, a dodecyl group, a pentadecyl group, etc.

The acylamino group shown by X preferably includes 7 to 40 carbon atoms and is preferably an alkanamido group, more preferably

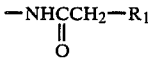

(wherein $R_1$ represents a hydrogen atom, a phenoxy group, an alkyl group having 4 to 15 carbon atoms, or a phenoxy group substituted by an alkyl group having 4 to 15 carbon atoms.

The sulfonamido group shown by X preferably includes 6 to 16 carbon atoms and is preferably a benzenesulfonamido group or an alkanesulfonamido group, more preferably

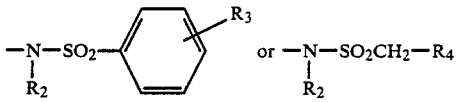

(wherein $R_2$ represents a hydrogen atom or a methyl group; $R_3$ represents a hydrogen atom or an alkyl group having 1 to 12 carbon atoms; and $R_4$ represents an alkyl group having 7 to 14 carbon atoms).

The carbamoyl group shown by X preferably includes 6 to 27 carbon atoms and is more preferably

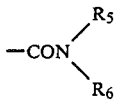

(wherein $R_5$ represents a hydrogen atom or an alkyl group having 4 to 10 carbon atoms; $R_6$ represents an alkyl group having 4 to 16 carbon atoms, a phenyl group, or a substituted phenyl group (the substituent being a nitro group, a cyano group, an alkyl group such as methyl group, etc., or a halogen atom such as chlorine atom, etc.).

The sulfamoyl group shown by X preferably includes 6 to 22 carbon atoms, more preferably

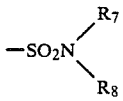

(wherein $R_7$ represents a hydrogen atom or an alkyl group having 1 to 4 carbon atoms and $R_8$ represents an alkyl group having 4 to 18 carbon atoms, a phenyl group, or a substituted phenyl group (the substituent being a nitro group, a cyano group, an alkyl group such as methyl group, etc., or a halogen atom such as a chlorine atom, etc.).

The sulfonyl group shown by X preferably includes 6 to 10 carbon atoms and is preferably $—SO_2—R_9$ (wherein $R_9$ represents a phenyl group or a phenyl group substituted by an alkoxy group having 6 to 10 carbon atoms).

Preferred examples of the heterocyclic group shown by X are a 2-benzoxazolyl group, a 2-benzothiazolyl group, a 2-pyrimizolyl group, a 2-pyridyl group, etc.

The aryl group shown by X preferably includes 6 to 10 carbon atoms and preferred examples are a phenyl group, a naphthyl group, and a substituted phenyl group (e.g., a phenyl group substituted by a nitro group, a cyano group, an alkyl group such as methyl group, etc., or a halogen atom such as chlorine atom, etc.). In particular, a phenyl group is preferred.

Preferred examples of the heterocyclic amino group shown by X are a triazine group, a 2-benzoxazolylamino group, a 2-benzothiazolylamino group, a 2-pyrimidylamino group, a 2-pyridylamino group, etc.

The alkoxycarbonyl group shown by X preferably includes 7 to 17 carbon atoms.

Preferred examples of the alkylene group shown by Y of general formula (II) are a methylene group and a methylene group substituted by an alkyl group having 2 to 6 carbon atoms (for example, $-CH_2CH_2-$).

The alkylene group shown by Ro of —CONH-RoNHCO— shown by Y has the same significance as the alkylene group shown by Y. In particular, Ro is preferably $-CH_2-CH_2-$.

It has never been anticipated by conventional information that the use of the compounds of this invention would remarkably prevent the occurrence of the foregoing image contaminations while causing less undesirable influences on other photographic properties. In particular, the remarkably effects obtained by the compounds of this invention as compared to the compounds disclosed in U.S. Pat. No. 3,312,552 is believed to demonstrate the synergistic effects obtained from the present invention by increasing the chelating faculty with a metal and reducing the dissolving rate of the compounds of this invention from the silver halide photographic materials into a processing solution when processing the photographic materials. Furthermore, the present invention also provides the following unexpected results: when a large amount of silver halide photographic materials using the compounds of this invention are processed, the processing solution is less deteriorated with the passage of time.

Preferred examples of the compounds of this invention shown by the foregoing general formulae (I), (II) and (III) are illustrated below but the compounds of this invention are not limited to them.

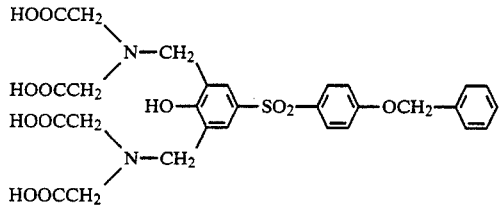
I-1

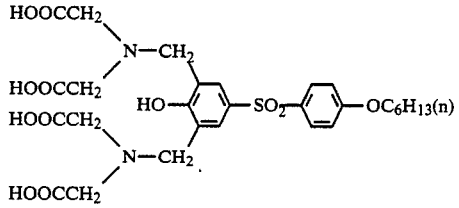
I-2

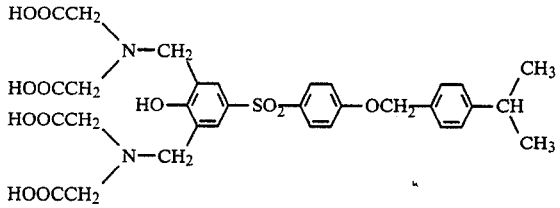
I-3

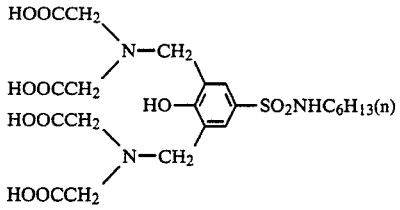
I-4

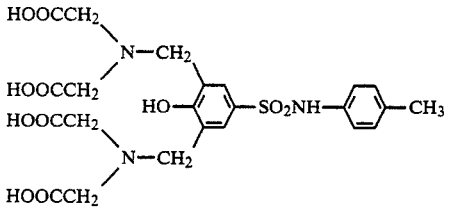
I-5

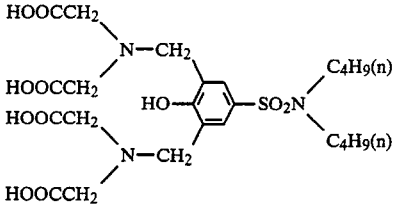
I-6

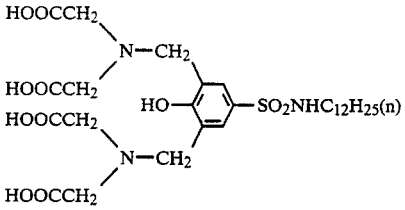
I-7

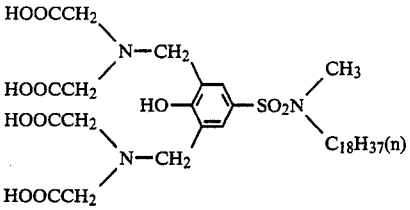
I-8

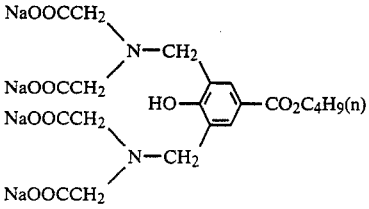
I-9

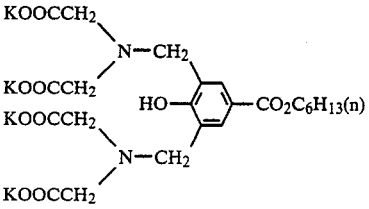
I-10

-continued
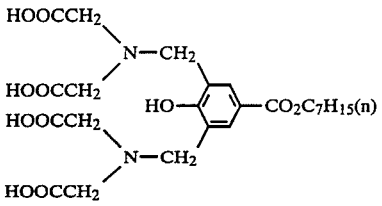
I-11
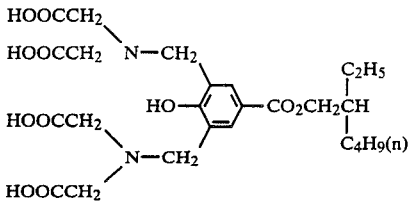
I-12
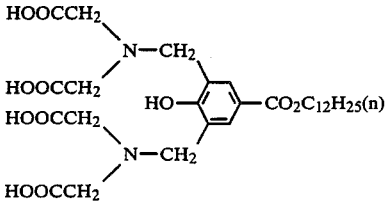
I-13
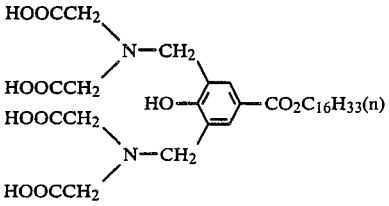
I-14
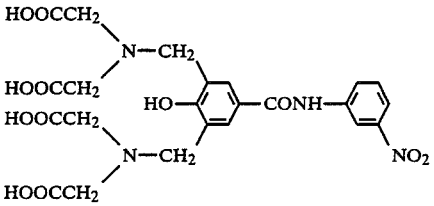
I-15
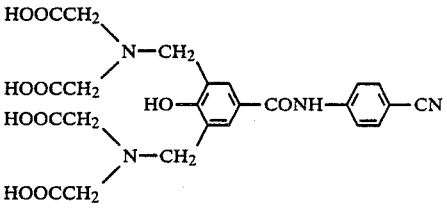
I-16
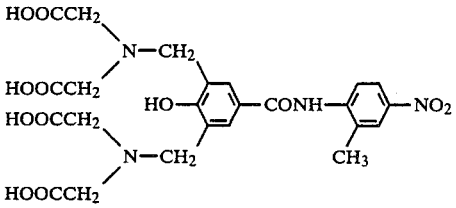
I-17
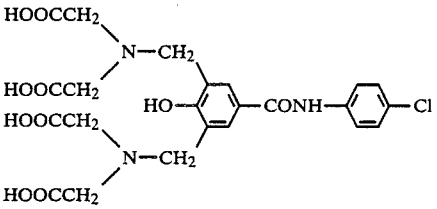
I-18
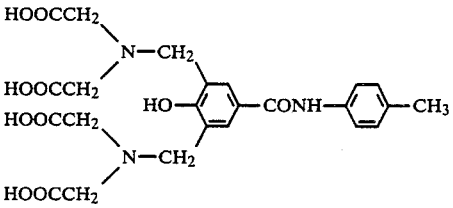
I-19
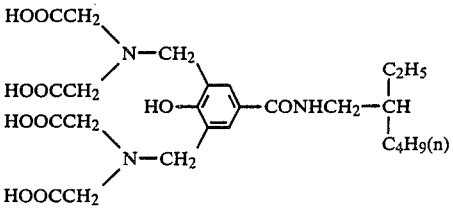
I-20
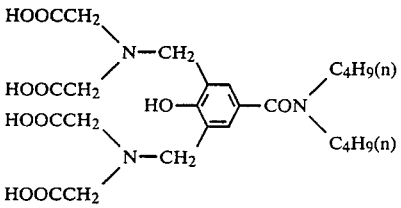
I-21
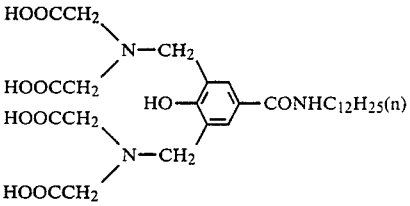
I-22
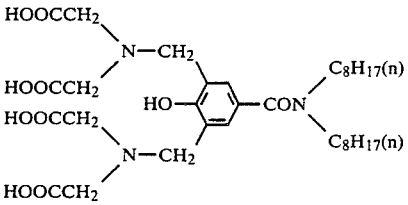
I-23
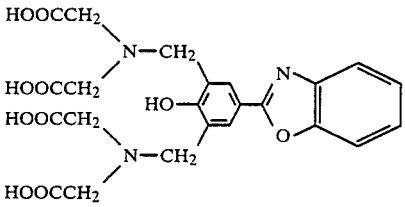
I-24

-continued
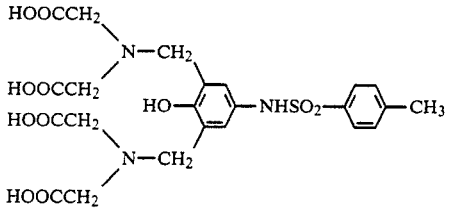
I-25
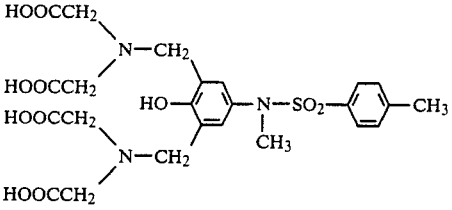
I-26
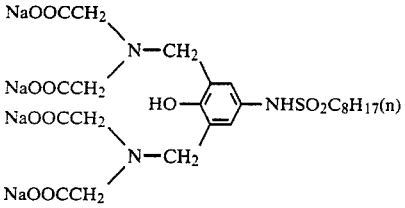
I-27
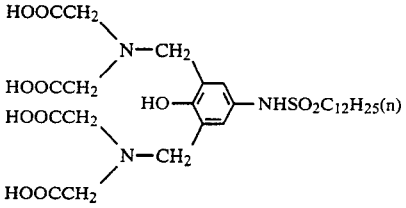
I-28
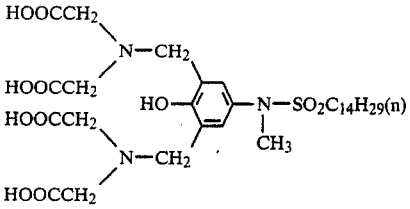
I-29
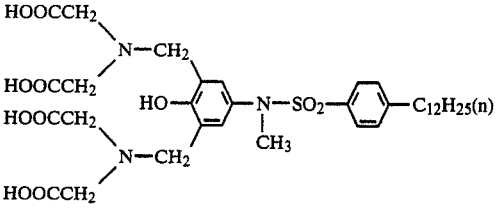
I-30
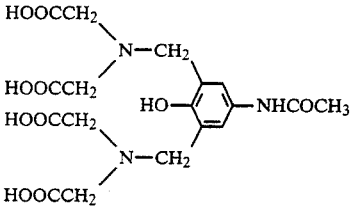
I-31
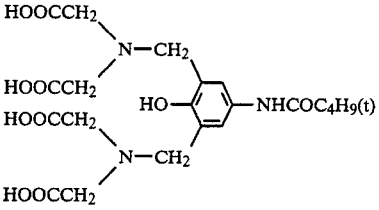
I-32
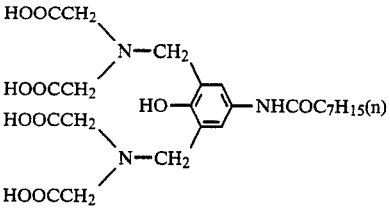
I-33
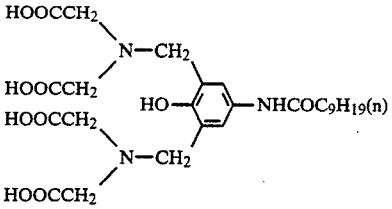
I-34
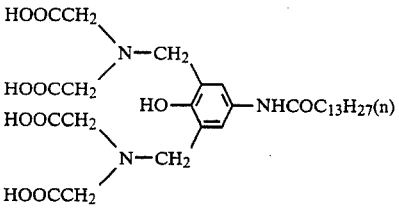
I-35
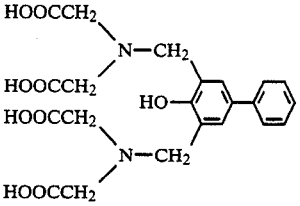
I-36
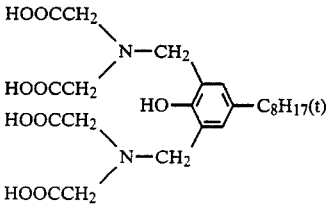
I-37
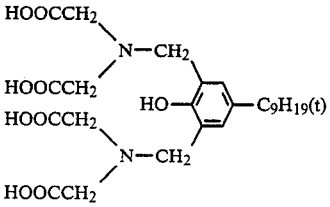
I-38

-continued
I-39
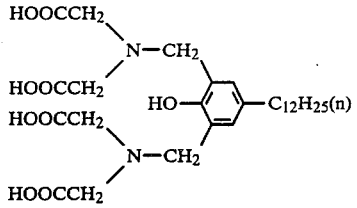
I-40
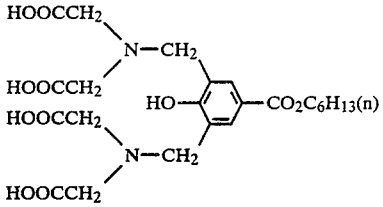
I-41
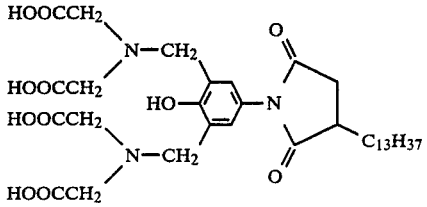
I-42
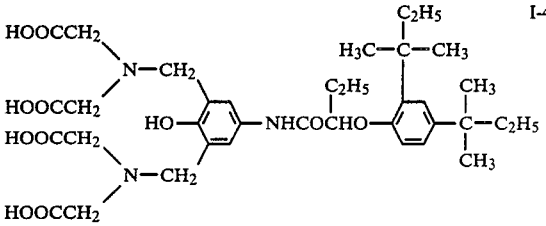
I-43
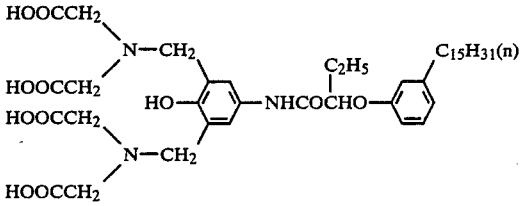
I-44
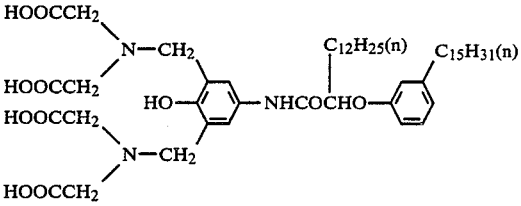
II-1
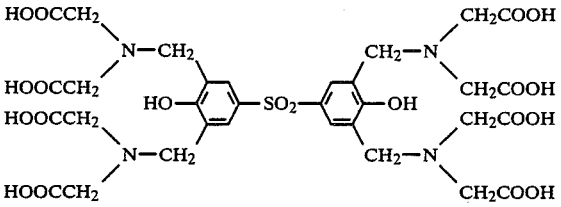
II-2
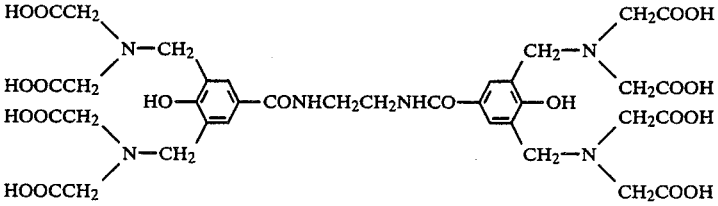
II-3
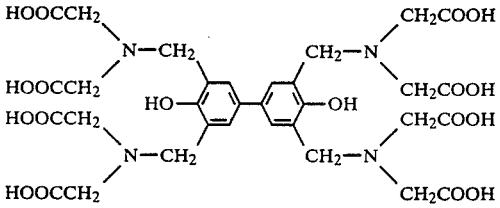
II-4
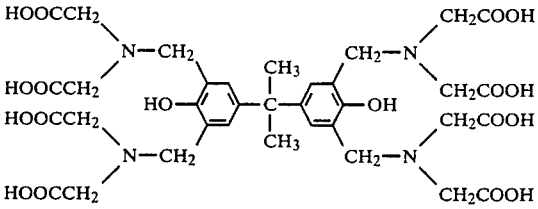

-continued

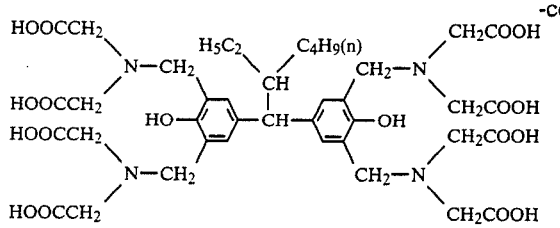

II-5

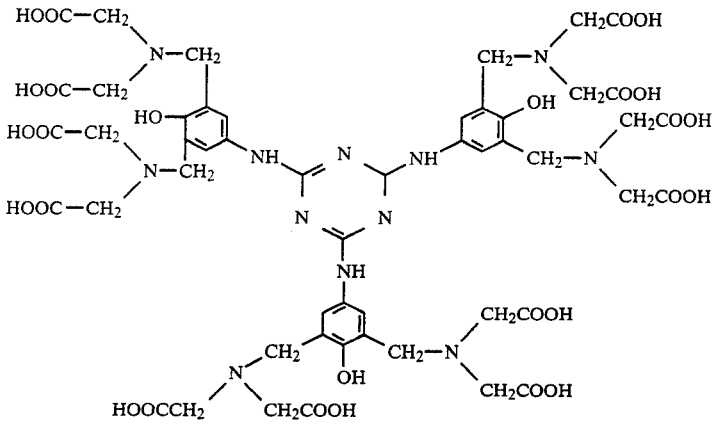

III-1

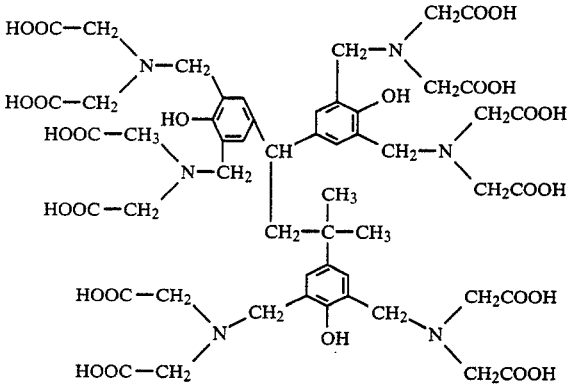

III-2

The chelating compounds used in this invention can be prepared by a Mannich reaction in a one reaction step from commercially available phenols or phenols which can be easily produced. That is, these compounds can be prepared by the methods described in "Helv. Chim. Acta"; 35, 1785 (1952) and Kagehira Ueno, "Chemistry of EDTA. Complexans"; pages 99–105 (1977), published by Nanko Do K. K.

Synthesis methods for typical compounds shown by general formulae (I), (II) and (III) are shown below.

SYNTHESIS EXAMPLE 1

Synthesis of 4-(2-ethylhexyloxycarbonyl)-2,6-di[N,N-bis(carboxymethyl)aminomethyl]phenol (Compound I-8)

In a mixture of 200 ml of distilled water and 150 ml of ethanol were suspended 247 g (1.86 mole) of iminodiacetic acid and 56 g (1.87 mole) of paraformaldehyde and then a solution of 148 g (3.7 moles) of sodium hydroxide dissolved in 200 ml of water was gradually added dropwise to the suspension with stirring.

Thereafter, a solution of 155 g (0.62 mole) of 4-(2-ethylhexyloxycarbonyl)phenol dissolved in 150 ml of ethanol was added to the foregoing mixture and the resultant mixture was heated to an inside temperature of 80° to 85° C. for 6 hours with stirring. After the reaction was over, ethanol was distilled off under reduced pressure from the reaction mixture, distilled water was added to the residue thus formed to provide 4 liters of a solution, and 6N hydrochloric acid was gradually added dropwise to the solution with stirring. Precipitates were deposited at a pH near 1.5, the supernatant solution was removed, and the precipitates were collected, washed well with water, and dried. Thereafter, the precipitates were suspended in acetone and after stirring the suspension for one hour, the dispersion was filtered to collect the foregoing precipitates, which were dried to provide 250 g (yield of 75%) of the desired compound. Melting point: 133° to 141° C.

SYNTHESIS EXAMPLE 2

Synthesis of 4-(4-benzyloxyphenylsulfonyl)-2,6-di[N,N-bis(carboxymethyl)aminomethyl]phenol (Compound I-1)

A mixture of 272 g (0.8 mole) of 4-(4-benzyloxyphenyl)sulfonylphenol (the product prepared by half-benzyloxylating 4,4'-dihydroxydiphenylsulfone with benzyl chloride under an ordinary alkylation condition followed isolation), 425.6 g (3.2 moles) of iminodiacetic acid, 115.2 g (0.38 mole) of paraformaldehyde, 500 ml of ethanol, and 300 ml of distilled water was stirred at 20° C. and a solution of 256 g of sodium hydroxide dissolved in 400 ml of water was added dropwise to the mixture over a period 45 minutes. (The inside temperature increased to 60° C.) The mixture was heated to an inside temperature of 80° C. for 24 hours with stirring. After cooling, 5 liters of distilled water was added to the mixture and about 220 ml of concentrated hydrochloric acid was added dropwise thereto with stirring to adjust the pH to 4.5 After further stirring the reaction mixture for one hour, insoluble matters were removed by filtration and then 6N hydrochloric acid was gradually added dropwise to the filtrate to adjust the pH to 1.5 to 2.0. Crystals thus deposited were collected by centrifugal filtration, washed with about 5 liters of distilled water, and then dried. The dried crystals were dissolved in 5 liters of methanol and after heating the solution for 30 minutes with the addition of 50 g of activated carbon, the solution was filtered while hot and gradually cooled with stirring, whereby crystals were deposited, which were collected by filtration and dried to provide 373 g (the yield for phenol was 74.0%) of the desired compound. The melting point was 138° to 143° C.

Other compounds shown by general formula (I), (II) or (III) can be also easily produced based on the foregoing synthesis methods and the methods described in the foregoing literatures. For example, the compounds of general formula (I) wherein X is a sulfonyl group, sulfamoyl group, or a carbamoyl group can be easily prepared based on Synthesis Example 1 and the compounds of general formula (I) wherein X is an alkyl group, a phenyl group, an alkanamido group, a sulfonamido group, an alkoxycarbonyl group, or a heterocyclic group can be easily prepared based on Synthesis Example 2. Furthermore, the compounds of general formula (II) wherein Y is $—SO_2—$ or $—CONHCH_2CH_2NHCO—$ can be prepared based on Synthesis Example 1 and the compounds of general formula (II) wherein Y is an alkylene group or is not attached (when n is 0) can be easily prepared based on Synthesis Example 2. Also, the compounds of general formula (III) can be easily prepared based on Synthesis Example 1 or 2.

The compound of this invention can be incorporated in a photographic material as a solution in an aqueous solution of an alkali salt such as potassium hydroxide, sodium hydroxide, etc., or can be incorporated, if necessary, as a solution in an organic solvent such as methanol, ethanol, ethyl acetate, etc. Also, the compound of this invention may be dissoled in a high-boiling organic solvent and the solution thereof may be dispersed by emulsification in a hydrophilic binder.

The compounds of this invention may be used solely or as a mixture of them. The addition amount of the compound of this invention largely depends upon the kind of silver halide photographic material but usually is used at a coverage of 0.01 to 5 $g/m^2$, preferably 0.1 to 1 $g/m^2$.

There is no limitation with respect to the layer of silver halide photographic material in which the compound of this invention is incorporated. The compound of this invention can be incorporated in a silver halide emulsion layer as well as a protective layer, a filter layer, an interlayer, an antihalation layer, a backing layer, etc. The compound may be further incorporated in a support. Furthermore, the compound may be incorporated in plural layers.

The silver halide photographic material for which the compound of this invention is used may be a black-and-white photographic material or a color photographic material. The compound of this invention can be also used for a silver halide photographic material utilizing a diffusion transfer process.

The silver halide emulsion used for the silver halide photographic material of this invention may be any desired silver halide emulsion such as a silver chloride emulsion, a silver bromide emulsion, silver iodide emulsion, etc., or may be a mixture of them.

The silver halide photographic emulsions used in this invention can be prepared by using the methods described in, for example, P. Glafkides, "Chimie et Physique Photographique" (published by Paul Montel Co., 1967); G. F. Duffin, "Photographic Emulsion Chemistry" (published by The Focal Press, 1966); V. L. Zelikman et al, "Making and Coating Photographic Emulsion" (published by The Focal Press, 1964). That is, the photographic emulsions may be prepared by an acid process, a neutralization process, an ammonia process, etc., and the reaction of a soluble silver salt and a soluble halide for producing silver halide emulsions may be performed by a single jet mixing process, a double jet mixing process, or a combination of them.

The photographic emulsions used in this invention may be spectrally sensitized by methine dyes or other dyes. These sensitizing dyes may be used solely or as a combination of them and the combination is sensitizing dyes is frequently used for supersensitization. The photographic emulsions used in this invention may contain a dye having no spectral sensitizing action by itself or a compound substantially absorbing no visible light and showing supersensitization together with a sensitizing dye.

Examples of the sensitizing dyes, combinations of dyes showing supersensitization, and compounds showing supersensitization are described in Paragraph IV-J of *Research Disclosure,* Vol. 176, 17643 (published December 1978).

In the casse of color photographic materials, the photographic emulsions may include couplers, colored couplers, DIR couplers, etc., and further in the case of color photographic materials for color diffusion transfer process, the photographic emulsions may contain diffusible dye-releasing couplers, dye developing agents, redox compounds capable of releasing diffusible dyes, etc.

That is, the photographic emulsions used in this invention may contain the compounds capable of coloring at oxidative coupling with an aromatic primary amine developing agent (e.g., a phenylenediamine derivative and an aminophenol derivative) in a color development. For example, there are 5-pyrazolone couplers, pyrazolobenzimidazole couplers, cyanoacetylcumarone couplers, open chain acylacetonitrile couplers, etc., as magenta couplers; acylacetamide couplers such as benzoylacetanilides, pivaloylacetanilides, etc., as yellow couplers; and naphthol couplers, phenol couplers, etc., as cyan couplers. As these couplers, non-diffusible couplers having a hydrophobic group called as "a ballast group" in the molecule are desirable. The couplers may be of 4-equivalent or 2-equivalent to silver ion. Also, these couplers may be colored couplers having a color correction effect or couplers releasing a development inhibitor with the progress of development (so-called DIR couplers).

The photographic emulsions may contain non-coloring DIR coupling compounds, which give colorless coupling reaction products and release development inhibitors, in addition to DIR couplers.

Preferred examples of magenta coloring couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Pat. No. 1,810,464; West German Patent Application (OLS) Nos. 2,408,665, 2,417,945, 2,418,959 and 2,424,467; Japanese Patent Publication Nos. 6031/65, 58922/77, 129538/74, 74027/74, 159336/75, 42121/77, 74028/74, 60233/75, 26541/76, 55122/78, etc.

Preferred examples of yellow coloring couplers are described in U.S. Pat. Nos. 2,875,057, 3,265,506, 3,408,194, 3,551,155, 3,582,322, 3,725,072 and 3,891,445; West German Pat. No. 1,547,868; West German Patent Application (OLS) Nos. 2,219,917, 2,261,361 and 2,414,006; British Pat. No. 1,425,020; Japanese Patent Publication No. 10783/76; Japanese Patent Application (OPI) Nos. 26133/73, 73147/73, 102636/76, 6341/77, 123342/77, 130442/77, 21827/76, 87650/75, 82424/77, 115219/77, etc.

Preferred examples of cyan coloring couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929; West German Patent Application (OLS) Nos. 2,414,830 and 2,454,329; Japanese Patent Application (OPI) Nos. 59838/73, 26034/76, 5055/73, 146828/76, 69624/77, 90932/77, etc.

Preferred examples of colored couplers used in this invention are described in U.S. Pat. No. 3,476,560; Japanese Patent Publication Nos. 2016/69, 22335/63, 11304/67 and 32461/69; Japanese Patent Application (OPI) Nos. 26034/76 and 42121/77; West German Patent Application (OLS) No. 2,418,959, etc.

Examples of DIR couplers used in this invention are described in U.S. Pat. Nos. 3,227,554, 3,617,291, 3,701,783, 3,790,384 and 3,632,345; West German Patent Application (OLS) Nos. 2,414,006, 2,454,301 and 2,454,329; British Pat. No. 953,454; Japanese Patent Application (OPI) Nos. 69624/77 and 122335/74; Japanese Patent Publication No. 16141/76, etc.

The photographic materials of this invention may contain compounds releasing development inhibitors with the progress of development in addition of DIR couplers and examples of these compounds are described in U.S. Pat. Nos. 3,297,445 and 3,379,529; West German Patent Application (OLS) No. 2,417,914; Japanese Patent Application (OPI) Nos. 15271/77 and 9116/78.

Various compounds can be utilized as dye image providing compounds and in this case couplers and dye-releasing redox compounds are particularly useful.

In dye-releasing redox compounds, the compounds the oxidized products of which release dyes by an alkali hydrolysis are described in U.S. Pat. Nos. 4,053,312, 4,055,428, 4,076,529, 4,152,153, 4,135,929 and 4,336,322; Japanese Patent Application (OPI) Nos. 149328/78, 104343/76, 46730/78, 130122/79, 3819/78, 12642/81 and 16130/81, etc.

In the dye-releasing redox compounds, yellow dye-releasing compounds are described in U.S. Pat. No. 4,013,633; Japanese Patent Application (OPI) Nos. 149328/78 and 114930/76; Japanese Patent Application No. 148237/79; Research Disclosure", 17630 (1978); ibid. 16475 (1977), etc.

Examples of magenta dye-releasing compounds are described in U.S. Pat. Nos. 3,954,476, 3,931,144 and 3,932,308; Japanese Patent Application (OPI) Nos. 23628/76, 106727/77, 65034/79, 161332/79, 4028/80, 36804/80, 73057/81, 71060/81 and 134850/80; West German Patent Application (OLS) No. 2,847,371, etc.

Examples of cyan dye-releasing compounds are described in U.S. Pat. Nos. 3,942,987, 3,929,760 and 4,013,635; Japanese Patent Application (OPI) Nos. 109928/76, 149328/78, 8827/77, 143323/78, 47823/78 and 71061/81, etc.

Also, redox compounds of the type that the non-oxidized compounds release dyes by causing ring closing, etc., are described in U.S. Pat. Nos. 4,139,379 and 3,980,479; West German Patent Application (OLS) Nos. 2,402,900, 2,448,811, etc.

The silver halide photographic materials of this invention may further contain additives known in the field of the art, such as stabilizers, whitening agents, filter dyes, antifading agents, coating adis, hardening agents, color mixing preventing agents, etc. Preferred examples of these compounds are described in *Research Disclosure,* Vol. 176, 17643 (December 1978).

The invention will further be illustrated in and by the following examples. However, the scope of the invention is not limited to the examples.

EXAMPLE 1

Film A

To a light-sensitive silver halide emulsion containing 120 g of silver iodobromide (I: 3 mole%) per kilogram of the emulsion was added a solution of 5 g of the image contamination-preventing compound of this invention, I-1 dissolved in 10 ml of an aqueous 1N KOH solution and after adjusting the pH of the mixture to 7, the coating composition thus prepared was coated on a transparent support and dried to provide sample film A. Also, a photographic film was prepared in the same manner as above without adding the image contamination preventing agent to provide a sample film as a blank.

Films B to G

By following the same procedure used for preparing film A but using various image contamination preventing compounds shown in Table 1, films B to G were produced.

Each of the sample films A to G and the blank film was cut into 10 mm widths. Fine iron powder was dusted onto the films and after allowing the films to stand for one day at normal temperature, the films were developed by the following developer A for 5 minutes at 30° C. and fixed by an ordinary method.

| Developer A: | |
|---|---|
| p-Methylaminophenol | 3.5 g |
| Hydroquinone | 9.0 g |
| Potassium metabisulfite | 0.1 g |
| Sodium sulfite | 60 g |
| Sodium carbonate | 40 g |
| Potassium bromide | 4.0 g |
| Sodium metaphosphate | 4.0 g |
| Water to make | 1 liter |

The number of black spots observed on each film thus developed was measured and recorded in Table 1 as a relative value for the number thereof on the blank film being 100.

TABLE 1

| Film No. | Compound No. | Spot No. (relative value) | Note |
|---|---|---|---|
| Blank | — | 100 | |
| A | I-1 | 10 | Compound of this invention |
| B | I-14 | 13 | Compound of this invention |
| C | I-16 | 15 | Compound of this invention |
| D | III-1 | 8 | Compound of this invention |
| E | [a] | 40 | Compound shown in U.S. Pat. No. 3,312,552 |
| F | [b] | 35 | Compound shown in U.S. Pat. No. 3,312,552 |
| G | [c] | 35 | Compound shown in U.S. Pat. No. 3,312,552 |

Compounds [a], [b] and [c] used as the comparison compounds in the experiments were as follows.

Comparison compound [a]

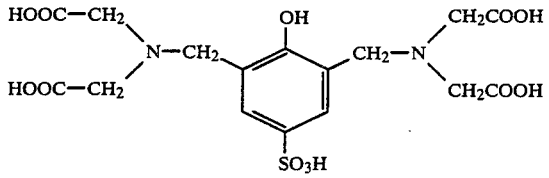

Comparison compound [b]

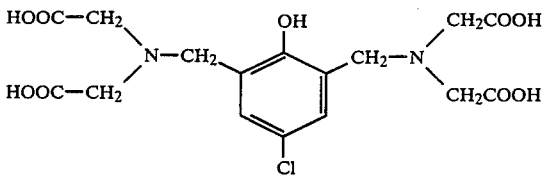

Comparison compound [c]

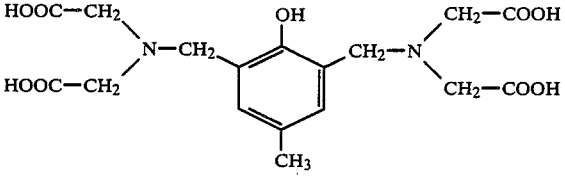

It was confirmed by the experiment that sample films A to D containing the compounds of this invention showed substantially less spots and hence had a large capacity for the prevention of metal contamination. On the other hand, sample films E to G containing the compounds disclosed in U.S. Pat. No. 3,312,552 were inferior in their capacity for the prevention of metal contamination.

EXAMPLE 2

A sample was prepared by forming, in succession, the following silver halide emulsion layers and auxiliary layers on a triacetyl cellulose support having a subbing layer. In these layers gelatin containing less metal and ash was used.

A 1st layer: Low-sensitive emulsion layer:

In a mixture of 100 ml of tricresyl phosphate and 100 ml of ethyl acetate was dissolved 100 g of a cyan coupler, 2-(heptafluorobutylamido)-5-{2'-(2'',4''-di-t-aminophenoxy)butylamido}phenol, the solution was mixed with 1 kg of an aqueous 10% gelatin solution with stirring at high speed. The 500 g of the emulsion thus obtained was mixed with 1 kg of a red-sensitive silver iodobromide emulsion (containing 70 g of silver and 60 g of gelatin, the iodine content was 4.5 mole%), and the resultant mixture was coated at a dry thickness of 2 microns.

A 2nd layer: High-sensitive red-sensitive emulsion layer:

In a mixture of 100 ml of tricresyl phosphate and 100 ml of ethyl acetate was dissolved 100 g of a cyan coupler, 2-(heptafluorobutylamido)-5-{2'-(2'',4''-di-t-aminophenoxy)butylamido}phenol, the solution was mixed with 1 kg of an aqueous 10% gelatin solution with stirring at high speed. The 1,000 g of emulsion thus obtained was mixed with 1 kg of a red-sensitive silver iodobromide emulsion (containing 70 g of silver and 60 g of gelatin, the iodine content was 4.5 mole%), and the resultant mixture was coated at a dry thickness of 2 microns.

A 3rd layer: Interlayer:

In a mixture of 100 ml of dibutyl phthalate and 100 ml of ethyl acetate was dissolved 70 g of 2,5-di-t-octylhydroquinone, the solution was mixed with 1 kg of an aqueous 10% gelatin solution with stirring at high speed, 1 kg of the emulsion thus obtained was mixed with 1 kg of an aqueous 10% gelatin solution, and the resultant mixture was coated at a dry thickness of 1 micron.

A 4th layer: Low-sensitive green-sensitive emulsion layer:

A mixture of 500 g of an emulsion prepared by following the same procedure as when preparing the emulsion for the 1st layer except that a magenta coupler, 1-(2,4,6-trichlorophenyl)-3-{3-(2,4-di-t-amylphenoxyacetamido)benzamido}-5-pyrazolone was used in place of the cyan coupler and 1 kg of a green-sensitive silver iodobromide emulsion (containing 70 g of silver and 60 g of gelatin, the iodine content was 2.5 mole%) was coated at a dry thickness of 2.0 microns.

A 5th layer: A high-sensitive green-sensitive emulsion layer:

A mixture of 1,000 g of an emulsion prepared by following the same procedure as when preparing the emulsion for the 1st layer except that a magenta coupler, 1-(2,4,6-trichlorophenyl)-3-{3-(2,4,6-di-t-amylphenoxyacetamido)benzamido}-5-pyrazolone was used in place of the cyan coupler and 1 kg of a green-sensitive silver iodobromide emulsion (containing 70 g of silver and 60 g of gelatin, the iodine content was 2.5 mole%) was coated at a dry thickness of 2 microns.

A 6th layer: Interlayer:

A mixture of 1 kg of the emulsion having the same composition as that used for the 3rd layer and 1 kg of an aqueous 10% gelatin solution was coated at a dry thickness of 1 micron.

A 7th layer: Yellow filter layer:

An emulsion containing a yellow colloid silver was coated at a dry thickness of 1 micron.

A 8th layer: Low-sensitive blue-sensitive emulsion layer:

A mixture of 1,000 g of the emulsion prepared by following the same procedure as when preparing the emulsion for the 1st layer except that a yellow coupler, α-(pivaloyl)-α-(1-benzyl-5-ethoxy-3-hydantoinyl)-2-chloro-5-dodecyloxycarbonylacetanilide was used in place of the cyan coupler and 1 kg of a blue-sensitive silver iodobromide emulsion (containing 70 g of silver and 60 g of gelatin, the iodine content was 2.5 mole%) was coated at a dry thickness of 2.0 microns.

A 9th layer: High-sensitive blue-sensitive emulsion layer:

A mixture of 1,000 g of the emulsion prepared by following the same procedure as when preparing the emulsion for the 1st layer except that a yellow coupler, α-(pivaloyl)-α-(1-benzyl-5-ethoxy-3-hydantoinyl)-2-chloro-5-dodecyloxycarbonylacetanilide was used in place of the cyan coupler and 1 kg of a blue-sensitive silver iodobromide emulsion (containing 70 g of silver and 60 g of gelatin, the iodine content was 2.5 mole%) was coated at a dry thickness of 2.0 microns.

A 10th layer: Second protective layer:

A mixture of 1 kg of the emulsion having the same composition as the emulsion used for the 3rd layer and 1 kg of an aqueous 10% gelatin solution was coated at a dry thickness of 2 microns.

A 11th layer: First protective layer:

An aqueous 10% gelatin solution containing a fine grain silver halide emulsion (1 mole% silver iodobromide emulsion having a grain size of 0.15 micron) which was not chemically sensitized was coated at a silver coverage of 0.3 g/m$^2$ and a dry thickness of 1 micron.

The silver halide photographic material prepared by the foregoing manner was used as a blank. Then, silver halide photographic materials, H, I, J and K were also prepared by the same manner as when preparing the blank except that the image contamination preventing compounds of this invention or a comparison compound was used. Each of the compounds of this invention and the comparison compound was incorporated in the 7th layer and the 1st layer in a total amount of 2.5 g/m$^2$.

Each of the blank photographic material and photographic materials H to K thus prepared was cut into a width of 10 mm and after uniformly exposing each film, a fine aluminum powder was dusted onto the photographic material.

Then, each of these photographic materials was processed by the following steps:

| Processing step | | |
|---|---|---|
| Step | Temperature | Time |
| 1st development | 38° C. | 6 min. |
| Wash | " | 2 min. |
| Reversal | " | 2 min. |
| Color development | " | 6 min. |
| Adjustment | " | 2 min. |
| Bleach | " | 6 min. |
| Fix | " | 4 min. |
| Wash | " | 4 min. |
| Stabilization | normal temp. | 1 min. |
| Drying | | |

The compositions of the processing solutions used in the aforesaid processing steps were as follows.

| | |
|---|---|
| 1st developer | |
| Water | 700 ml |
| Sodium tetrapolyphosphate | 2 g |
| Sodium sulfite | 20 g |
| Hydroquinone.monosulfonate | 30 g |
| Sodium carbonate (mono-hydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |

-continued

| | |
|---|---|
| Potassium iodide (0.1% solution) | 2 ml |
| Water to make | 1 liter |
| pH 10.1 | |
| Reversal solution | |
| Water | 700 ml |
| Nitrilo.N,N,N—trimethylene phosphonic acid.6Na salt | 3 g |
| Stannous chloride (di-hydrate) | 1 g |
| p-Aminophenol | 0.1 g |
| Sodium hydroxide | 8 g |
| Glacial acetic acid | 15 ml |
| Water to make | 1 liter |
| Color developer | |
| Water | 700 ml |
| Tetrapolyphosphoric acid | 2 g |
| Sodium sulfite | 7 g |
| Sodium tertiary phosphate (12 $H_2O$) | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—(β-methanesulfonamidoethyl)-3-methyl-4-aminoaniline.sulfate | 11 g |
| Ethylenediamine | 3 g |
| Water to make | 1 liter |
| Adjusting solution | |
| Water | 700 ml |
| Ethylenediamine tetraacetic acid sodium (di-hydrate) | 8 g |
| Thioglycerine | 0.4 ml |
| Glacial acetic acid | 3 ml |
| Water to make | 1 liter |
| Bleach solution | |
| Water | 800 ml |
| Ethylenediamine tetraacetic acid sodium (di-hydrate) | 2.0 g |
| Ethylenediamine tetraacetic acid iron (III) ammonium (di-hydrate) | 120.0 g |
| Potassium bromide | 100.0 g |
| Water to make | 1 liter |
| Fixing solution | |
| Water | 800 ml |
| Ammonium thiosulfate | 80.0 g |
| Sodium sulfite | 5.0 g |
| Sodium hydrogensulfite | 5.0 g |
| Water to make | 1 liter |
| Stabilization solution | |
| Water | 800 ml |
| Formalin (37% by weight) | 5.0 ml |
| Fuji Dri Wel | 5.0 ml |
| Water to make | 1 liter |

The contaminations were observed on samples H to K thus processed (white, blue and red spots with black background) and the number thereof is shown in Table 2 as the relative value with the spot number of the blank film being 100.

TABLE 2

| Sample No. | Compound No. | Spot No. (relative value) | Note |
|---|---|---|---|
| Blank | — | 100 | |
| H | I-2 | 15 | Compound of this invention |
| I | I-26 | 10 | Compound of this invention |
| J | I-33 | 13 | Compound of this invention |
| K | [a] | 55 | Compound shown in U.S. Pat. No. 3,312,552 |

As is clear from Table 2, sample films H to J containing the compounds of this invention show substantially less spots and a large capacity for the prevention of metal contamination as compared to the comparison sample film K.

EXAMPLE 3

A color photographic material was prepared by forming, in succession, the following layers 1 to 6 on a paper support both the surfaces of which were laminated with polyethylene. In this case gelatin containing less metal and ash was used.

A 1st layer:

A blue-sensitive silver halide emulsion layer containing a silver chlorobromide emulsion (Br: 80 mole%) at a silver coverage of 400 mg/m$^2$, gelatin at a coverage of 1200 mg/m$^2$, a yellow coupler, α-pivaloyl-α-(2,4-dioxo-5,5'-dimethyloxazolidine-3-yl)-2-chloro-5-[α-(2,4-di-tert-pentylphenoxy)butanamido]acetanilide at a coverage of 300 mg/m$^2$, and a coupler solvent, dioctylbutyl phosphate at a coverage of 150 mg/m$^2$.

A 2nd layer:

An interlayer containing gelatin at a coverage of 1,000 mg/m$^2$.

A 3rd layer:

A green-sensitive silver halide emulsion layer containing a silver chlorobromide emulsion (Br: 50 mole%) at a silver coverage of 200 mg/m$^2$, gelatin at a coverage of 1,000 mg/m$^2$, a magenta coupler, 1-(2,4,6-trichlorophenyl)-4-(5-octyl-2-butyloxyphenylthio)-3-(2-chloro-5-tetradecanamidoanilino)-2-pyrazoline-5-one at a coverage of 160 mg/m$^2$, and a coupler solvent, trecresyl phosphate at a coverage of 160 mg/m$^2$.

A 4th layer:

A interlayer containing gelatin at a coverage of 1,200 mg/m$^2$, a ultraviolet absorbent, 2-(2-hydroxy-3-sec-butyl-5-tert-butylphenyl)benzotriazole at a coverage of 1,000 mg/m$^2$, and a ultraviolet absorbent solvent, dibutyl phthalate at a coverage of 250 mg/m$^2$.

A 5th layer:

A red-sensitive silver halide emulsion layer containing a silver chlorobromide emulsion (Br: 50 mole%) at a silver coverage of 300 mg/m$^2$, gelatin at a coverage of 1,000 mg/m$^2$, a cyan coupler, 2-[α-(2,4-di-tert-pentylphenoxy)-butanamido]-4,6-dichloro-5-methylphenol at a coverage of 400 mg/m$^2$, and a coupler solvent, dibutyl phthalate at a coverage of 200 mg/m$^2$.

A 6th layer:

A protective layer containing gelatin at a coverage of 1,000 mg/m$^2$.

The photographic material was a blank sample. Also, by following the same procedure as when preparing the foregoing blank sample except that the compound of this invention, Compound I-1 was incorporated in the 6th layer (protective layer), a photographic material of this invention was prepared. After during a fine iron powder onto each of the photographic materials thus prepared by the same manner as in Example 1, each sample was processed as follows.

| Processing step | Temperature | Time |
|---|---|---|
| Development | 33° C. | 3 min. 30 sec. |
| Blix | 33° C. | 1 min. 30 sec. |
| Wash | 28 to 35° C. | 3 min. |

-continued

| Processing step | Temperature | Time |
|---|---|---|
| Drying | | |

The composition of the processing solutions used in the aforesaid processing steps were as follows:

| | |
|---|---|
| Developer | |
| Benzyl alcohol | 15 ml |
| $Na_2SO_3$ | 5 g |
| Potassium bromide | 0.4 g |
| Hydroxylamine sulfate | 2 g |
| 4-Amino-3-methyl-N—ethyl-N—[β-(methanesulfonamido)ethyl]-p-phenylenediamine | 6 g |
| Triethanolamine | 10 ml |
| Sodium carbonate (mono-hydrate) | 30 g |
| Water to make | 1 liter |
| pH 10.1 | |
| Blix solution | |
| Ammonium thiosulfate (70 wt %) | 150 ml |
| Sodium sulfate | 15 g |
| Na[Fe(EDTA)] | 40 g |
| Ethylenediamine tetraacetic acid (EDTA) | 4 g |
| Water to make | 1 liter |
| pH 6.9 | |

The spots of cyan and blue of the samples after processing were observed and they were evaluated as in Example 2. As is clear from the results, it is understood that the sample containing the compound of this invention showed remarkably less formation of spots as compared to the blank sample.

EXAMPLE 4

By following the same procedure as when preparing the blank photosensitive material in Example 3 except that each of the compounds of this invention and the comparison compound shown in Table 4 was incorporated in the 6th layer (protective layer) of the photographic material, samples L to Q were prepared. Each of the foregoing samples and the blank sample prepared in Example 3 was exposed through a grey filter having a continuously changing density and then processed as in Example 3 except that the color developer having the following composition containing calcium was used and the density of the dye image in each sample was measured, the results being shown in Table 3.

| Color developer | |
|---|---|
| Water | 800 ml |
| Calcium nitrate | 1.2 g (300 ppm) |
| 1-Hydroxyethylidene-1,1-diphosphonic acid | 0.8 ml |
| Triethanolamine | 10 ml |
| Benzyl alcohol | 15 ml |
| Lithium chloride | 2.0 g |
| Potassium bromide | 0.5 g |
| Hydroxylamine sulfate | 3.0 g |
| Potassium sulfite | 2.0 g |
| 4-Amino-3-methyl-N—ethyl-N—[β-(methanesulfonamido)ethyl]-p-phenylenediamine | 5.0 g |
| Potassium carbonate | 30 g |
| Water added to make | 1 liter |

TABLE 3

| Sample | Calcium in Color Developer | Compound | Density Change (ΔD) Red | Green | Blue | Note |
|---|---|---|---|---|---|---|
| Blank | none | none | 0 | 0 | 0 | Standard |
| L | added | none | −0.15 | −0.25 | −0.08 | |

TABLE 3-continued

| Sample | Calcium in Color Developer | Compound | Density Change (ΔD) Red | Green | Blue | Note |
|---|---|---|---|---|---|---|
| M | added | I-3 | 0 | −0.05 | −0.01 | Compound of this invention |
| N | added | I-8 | 0 | −0.03 | 0 | Compound of this invention |
| O | added | I-28 | −0.01 | −0.05 | −0.03 | Compound of this invention |
| P | added | I-43 | 0 | 0 | 0 | Compound of this invention |
| Q | added | [a] | −0.10 | −0.15 | −0.04 | Compound shown in U.S. Pat. No. 3,312,552 |

Note:
Density change (ΔD): The density change at the exposure amount for giving a density 2.0 for blank sample.

As shown in Table 3, when the photographic material containing no compound of this invention was processed by a color developer containing calcium, the density of the image was lowered and further the tone of the image was changed as compared to when processing the photographic material with a color developer containing no calcium.

However, when the photographic material containing the compound of this invention was processed by a color developer containing calcium, the density of the image formed was scarecely reduced and also the change of the tone was scarecely observed.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having formed thereon a light-sensitive silver halide emulsion layer, and a compound represented by a general formula selected from the group consisting of (I), (II) and (III)

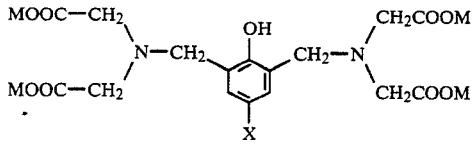

(I)

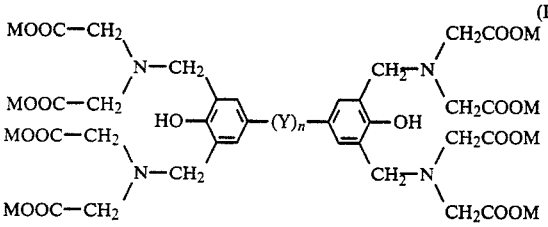

(II)

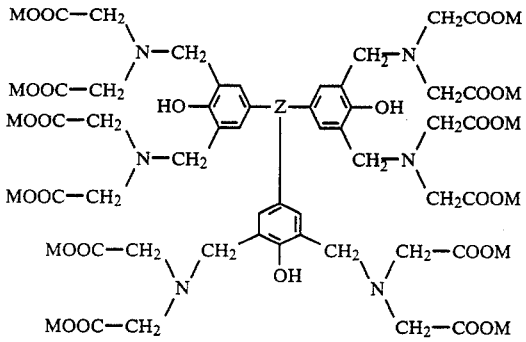

(III)

wherein X represents an alkyl group having 6 or more carbon atoms, an aryl group having 6 or more carbon atoms, an acylamino group having 7 or more carbon atoms, a heterocyclic amino group the heterocyclic moiety of which is 5- or 6-membered, a sulfonamido group having 6 or more carbon atoms, an alkoxycarbonyl group having 6 or more carbon atoms, a carbamoyl group having 6 or more carbon atoms, a sulfamoyl group having 6 or more carbon atoms, a sulfonyl group having 6 or more carbon atoms, or a 5- or 6-membered heterocyclic group; Y represents an alkylene group having 1 or more carbon atom, —$SO_2$—, or —CONH-RoNHCO— wherein Ro represents an alkylene group having 1 or more carbon atoms; Z represents

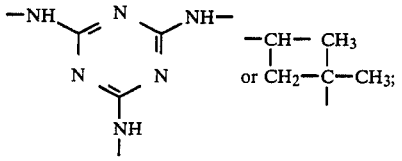

M represents a hydrogen atom, a sodium atom, or a potassium atom; and n represents 0 or 1.

2. A silver halide photographic material as claimed in claim 1, wherein X is an alkyl group containing 6 to 16 carbon atoms.

3. A silver halide photographic material as claimed in claim 1, wherein X is an aryl group containing 6 to 10 carbon atoms.

4. A silver halide photographic material as claimed in claim 1, wherein X is an acylamino group containing 7 to 40 carbon atoms.

5. A silver halide photographic material as claimed in claim 1, wherein X is a sulfonamido group containing 6 to 16 carbon atoms.

6. A silver halide photographic material as claimed in claim 1, wherein X is an alkoxycarbonyl group containing 7 to 17 carbon atoms.

7. A silver halide photographic material as claimed in claim 1, wherein X is a carbamoyl group containing 6 to 27 carbon atoms.

8. A silver halide photographic material as claimed in claim 1, wherein X is a sulfamoyl group containing 6 to 22 carbon atoms.

9. A silver halide photographic material as claimed in claim 1, wherein X is a sulfonyl group containing 6 to 10 carbon atoms.

10. A silver halide photographic material as claimed in claim 1, wherein the compound is present on the support in an amount in the range of 0.01 to 5 g/m$^2$.

11. A silver halide photographic material as claimed in claim 10, wherein the compound is present on the support in an amount in the range of 0.1 to 1 g/m$^2$.

* * * * *